US009299270B2

(12) United States Patent
Hosilyk

(10) Patent No.: US 9,299,270 B2
(45) Date of Patent: Mar. 29, 2016

(54) DOOR VACANCY INDICATOR

(71) Applicant: Rod Hosilyk, Fernley, NV (US)

(72) Inventor: Rod Hosilyk, Fernley, NV (US)

(73) Assignees: Steven Mares, Reno, NV (US); Joey Mares, Reno, NV (US)

( * ) Notice: Subject to any disclaimer, the term of this patent is extended or adjusted under 35 U.S.C. 154(b) by 297 days.

(21) Appl. No.: 13/861,538

(22) Filed: Apr. 12, 2013

(65) Prior Publication Data

US 2013/0269591 A1 Oct. 17, 2013

Related U.S. Application Data

(60) Provisional application No. 61/623,899, filed on Apr. 13, 2012.

(51) Int. Cl.

| | |
|---|---|
| ***G09F 19/04*** | (2006.01) |
| ***G09F 3/00*** | (2006.01) |
| ***G08B 5/02*** | (2006.01) |
| ***G09F 7/14*** | (2006.01) |

(52) U.S. Cl.

CPC .. *G09F 3/00* (2013.01); *G08B 5/02* (2013.01); *G09F 7/14* (2013.01); *G09F 19/04* (2013.01)

(58) Field of Classification Search

CPC ..... G08B 5/00; G08B 5/02; G08B 21/22; G09F 11/00; G09F 11/02; G09F 11/30; G09F 3/00; G09F 7/14; G09F 19/04; E05B 41/00

USPC ..... 116/86, 200, 204, 281, 284, 285; 40/459, 460, 491, 492, 493, 606.07, 40/907; 70/432, 441, DIG. 59; 232/37

See application file for complete search history.

(56) References Cited

U.S. PATENT DOCUMENTS

| | | | | | |
|---|---|---|---|---|---|
| 345,339 | A | * | 7/1886 | Vail | 40/460 |
| 391,215 | A | * | 10/1888 | Vail | 40/460 |
| 437,101 | A | * | 9/1890 | Dihrberg | 40/486 |
| 588,149 | A | * | 8/1897 | Hinckley | 40/460 |
| 720,871 | A | | 2/1903 | Allen et al. | |
| 747,252 | A | * | 12/1903 | Smith | 40/460 |
| 1,099,106 | A | * | 6/1914 | Wevat | 40/460 |
| 1,410,853 | A | | 3/1922 | Tollenaar | |
| 1,529,766 | A | * | 3/1925 | Bina | 40/460 |
| 4,052,954 | A | * | 10/1977 | Roy | 116/285 |
| 4,559,796 | A | * | 12/1985 | De Forrest, Sr. | 70/432 |
| 4,854,061 | A | * | 8/1989 | Khoshkish | 40/495 |
| 4,881,335 | A | * | 11/1989 | Khoshkish | 40/449 |
| 5,235,933 | A | | 8/1993 | Par'e et al. | |
| 5,253,908 | A | * | 10/1993 | Leonard, III | 292/289 |
| 5,861,806 | A | * | 1/1999 | Vories et al. | 340/555 |
| 7,316,086 | B2 | | 1/2008 | Schuling et al. | |
| 7,571,694 | B2 | | 8/2009 | Boerner | |
| 7,913,437 | B2 | | 3/2011 | Domenig et al. | |
| 8,284,018 | B2 | * | 10/2012 | Ibsies | 340/3.1 |
| 2002/0152949 | A1 | | 10/2002 | Turner | |
| 2011/0016938 | A1 | * | 1/2011 | Chi | 70/432 |

FOREIGN PATENT DOCUMENTS

| | | | | | |
|---|---|---|---|---|---|
| GB | 391314 | A | * | 4/1933 | G08B 5/00 |
| JP | 08028125 | A | * | 1/1996 | E05C 1/04 |

* cited by examiner

*Primary Examiner* — Richard A. Smith
(74) *Attorney, Agent, or Firm* — Ian Burns; ATIP Law

(57) ABSTRACT

A stall structure includes a door mounted between two pilasters. The stall also includes an occupancy indicator. The occupancy indicator is engaged by the action of closing the door so that the occupancy indicator changes from indicating the stall as vacant to indicating the stall as occupied. The indicator may include a display having a VACANT indicator and an OCCUPIED indicator. An engagement element may engage the stall structure as the door is closed and move the display from the VACANT indicating position to the OCCUPIED indicating position.

24 Claims, 16 Drawing Sheets

DOOR VACANCY INDICATOR

CROSS REFERENCE TO RELATED APPLICATIONS

This application claims priority to U.S. provisional patent application Ser. No. 61/623,899 filed Apr. 13, 2012 the contents of which are herein incorporated by reference.

FIELD OF THE INVENTION

The present invention relates to the field of information displaying devices, and more particularly to a device indicating whether a room, such as a public restroom toilet stall, is occupied.

BACKGROUND

Most public restroom toilet stalls do not have an indicator showing if the stalls are occupied, i.e., showing "occupied" and "vacant" status of each stall. It is therefore difficult and potentially embarrassing for a person wanting to use a stall to determine the status other than pulling or pressing on the door to see if it is latched.

SUMMARY OF ONE EMBODIMENT OF THE INVENTION

Advantages of One or More Embodiments of the Present Invention

The various embodiments of the present invention may, but do not necessarily, achieve one or more of the following advantages:

the ability to indicate the occupancy status of a stall, cubicle or similar structure having a door;

the ability to indicate the occupancy status for a wide viewing angle;

the ability to indicate the occupancy status at an appropriate viewing height;

the ability to mount an occupancy indicator to left and right opening doors;

the ability to mount an occupancy indicator for stall structures having inward opening and outward opening doors;

the ability to bias the occupancy indicator to a vacant indicating position; and the ability of the occupancy indicator to bias the door to an at least partially open position.

These and other advantages may be realized by reference to the remaining portions of the specification, claims, and abstract.

Brief Description of One Embodiment of the Present Invention

In one embodiment, there is provided an occupancy indicator comprising a housing, a mounting arrangement for mounting the housing to a stall structure, a display element and an engagement surface. The display element may be moveable between a vacant indicating position and an occupied indicating position. The engagement surface may be engaged by the stall structure during the operation of closing the door of the stall. The engagement surface may be operatively connected to the display element so that closing the door and engaging the engagement surface causes the display element to move from the vacant indicating position to the occupied indicating position.

In one embodiment, there is provided a stall structure including a door mounted between two pilasters. The stall also includes an occupancy indicator. The occupancy indicator is engaged by the action of closing the door so that the occupancy indicator changes from indicating the stall as vacant to indicating the stall as occupied.

In one embodiment, there is provided a method for indicating the occupancy status of a stall. The method comprises engaging a surface of an occupancy indicator by the action of moving a door of the stall into a closed door space. When the surface is engaged, the surface causes a display element to move from a vacant indicating position to an occupied indicating position.

The above description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF CERTAIN EMBODIMENTS OF THE PRESENT INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Figure 1:
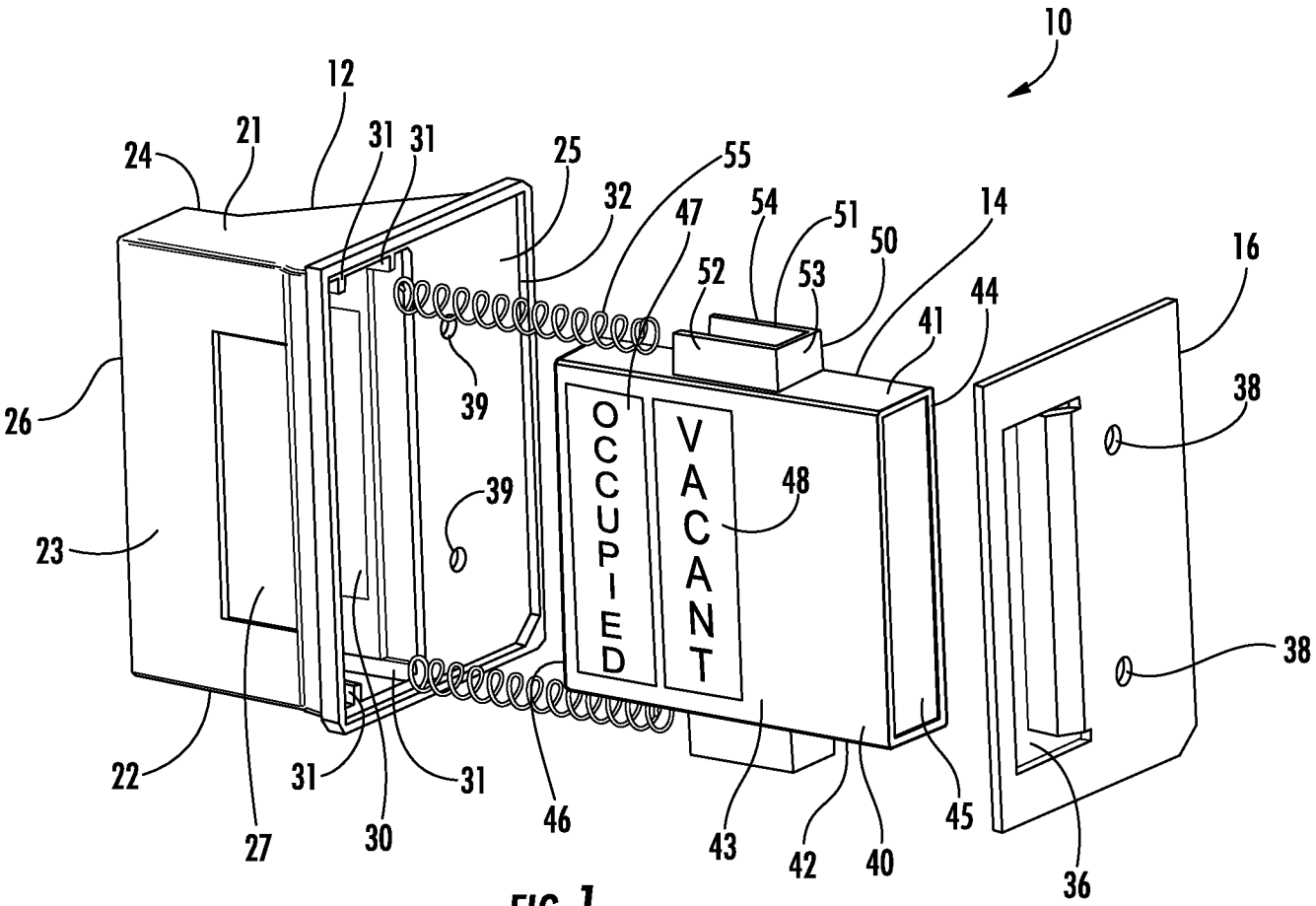
FIG. 1 is substantially an exploded view of the indicator of the present invention.

An occupancy indicator device in accordance with an embodiment of the invention will first be described with reference to FIGS. 1 to 4. In FIG. 1, there is shown an occupancy indicator 10 in an exploded perspective view. The indicator 10 comprises a housing 12, slider block 14 and a mounting plate 16.

The housing includes a top piece 21, bottom piece 22, opposing sides 23, 24, front 25 and back 26. The terms top, bottom, left, right, front, back and similar terms of orientation are used herein to aid in clarity of the description and are not intended to limit the orientation of the respective elements. The pieces of the housing 12 define a slot 30 which receives the slider block 14. Guide ribs 31 are provided on the inner surfaces of the top and bottom pieces that engage complementary guides of the slider block 14 as will be described in greater detail below.

The sides 23, 24, each include display apertures 27 that align with displays on the slider block for indicating status as will be described in more detail below.

The front 25 of the housing includes a recess 32 that receives a mounting plate 16. The mounting plate 16 is depicted as a rectangular piece sized to fit snugly within the recess 32, though other shapes may be used. The mounting plate 16 can be used as a drill template for securing the mounting plate and the housing to a stall structure. Alignment markings may be provided one or both of the mounting plate 16 or the housing 12 for aiding in aligning the device into the appropriate position on the stall structure. The mounting plate includes a slot 36 that aligns with the slot 30 of the housing. Drill holes 38, 39 may be provided in the mounting plate and the housing respectively for securing the mounting plate 16 to the housing 12 and for securing the complete assembly to the stall structure.

The housing 12 may be manufactured from plastic using a suitable molding process. Other materials and manufacturing processes will be apparent to the person skilled in the art.

The slider block 14 includes a generally rectangular piece 40 which may be molded from plastic using a suitable molding process. Other materials such as metal or wood may also be appropriate for the slider block. The rectangular block is depicted as hollow, which saves on material, but may also be solid.

The slider block piece 40 includes a top side 41, bottom 42, sides 43, 44, front 45 and back 46. On the sides 43, 44 are indicators 47, 48 indicating OCCUPIED and VACANT respectively. The indicators 47, 48 may be printed, embossed or adhered as labels onto the sides 43, 44. The sides 43, 44 may be recessed to receive the labels 47, 48. The labels 47, 48 may be provided on one or both of sides 43, 44.

A guide 50 may be formed on the top side 41 of the block piece 40. The guide includes opposing side walls 51, 52 extending upward of the top side 41. The side walls are spaced to fit within the guide ribs 31 of the housing 12. The guide 50 also includes an end wall 53 spanning across the side walls 51, 52. The walls 51, 52, 53 of the guide define a channel 54. The channel 54 receives a biasing device 55. The biasing device is depicted as a coil spring, though other biasing elements may be used including, without limitation, leaf springs, elastomers, magnets and the like.

While only the top guide 50 has been described, a similar guide may be provided on the bottom wall 42 of the slider block piece 40. Other configurations and locations of the guide 50 will be apparent to a person skilled in the art. For example, guides may be provided on the side walls as an alternative or in addition to the guide(s) on the top and bottom surfaces.

The occupancy indicator 10 may be assembled as follows. The biasing springs 55 are located in their respective channels 54 and the slider block 14 is inserted into the slot 30 of the housing 12 with the guides 50 being guided within guide ribs 31 of the housing. In this position, the springs 55 are constrained within their channels 54 at one end by the end wall 53 of guide 50 and at the other end by the back wall 26 of the housing 12. The front face 45 of the slider block 14 is then inserted through the slot 36 in the mounting plate 16 and the mounting plate 16 is then pressed into the recess 32 in the front wall 25 of the housing 12. The inner surface of the mounting plate 16 engages the end wall 53 of the guides and pushes the slider block into its resting or default position within the housing. The complete assembly may then be secured to a stall structure by fixing screws, rivets, bolts or similar attachments through the drill holes 38, 39. Other attachments, such as adhesives and the like, may also be used to secure the indicator assembly to the stall structure.

The slider block provides a display element and in this regard, the slider block 14 has two distinct positions within the housing 12. In a default position, the springs 55 urge the slider block 14 until the end wall 53 of the guides abut the mounting plate 16 with the front wall 45 of the slider block 14 protruding from the slot 36 of mounting plate 16. In this position, the VACANT indicator 48 aligns with the display aperture 27 of the housing 12. The OCCUPIED indicator 47 is hidden by the side wall 23 of the housing 12.

Figure 3:
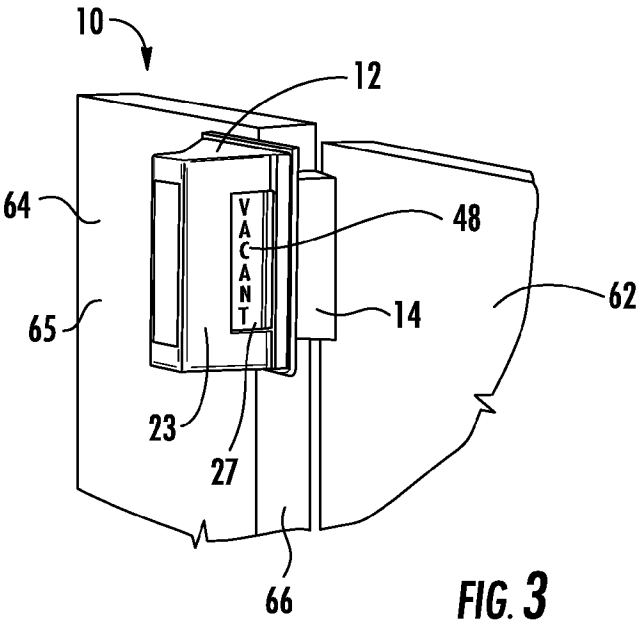
FIG. 3 is substantially a close up isometric view of the indicator of the present invention on a pilaster with the door in an open position.
Figure 2:
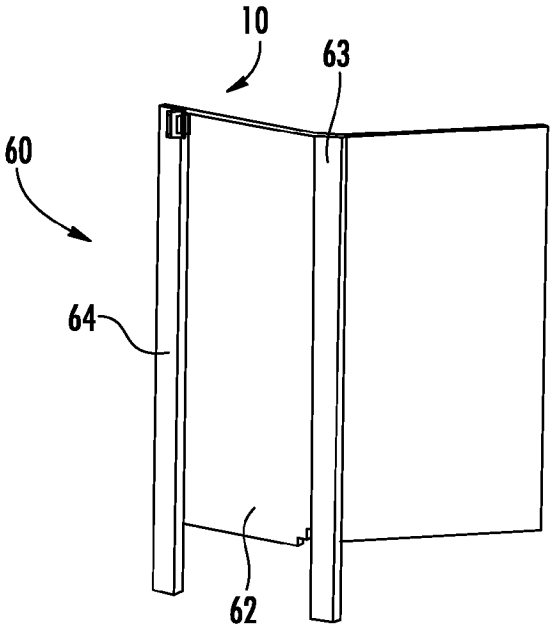
FIG. 2 is substantially an isometric view of the indicator of the present invention mounted on a pilaster.
Figure 4:
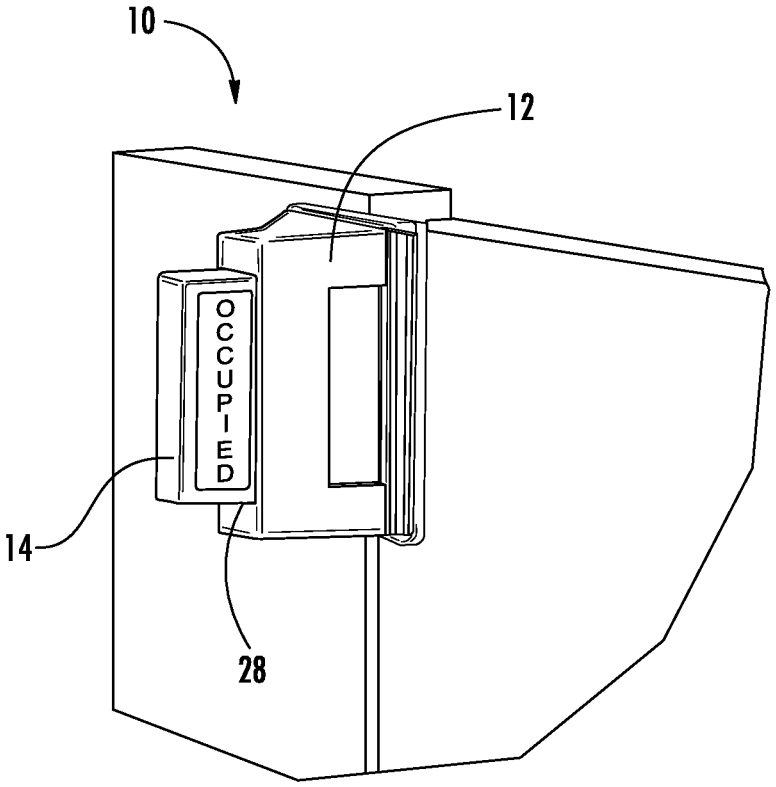
FIG. 4 is substantially a close up isometric view of the indicator of the present invention on a pilaster with the door in a closed position.

FIGS. 2-4 show the occupancy indicator 10 in use installed on a stall structure 60 that includes a moving door 62 that is pivotally attached to first pilaster 63 or similar support structure. In a closed position (FIG. 4), the door 62 comes into alignment with a second pilaster 64 or similar fixed support structure. The pilaster 64 includes a front face 65 and edge 66. The stall structure 60 may include a latch or similar (not shown) for locking the door in the closed position.

The occupancy indicator 10 is secured to the front face 65 of the pilaster 62 by screws or the like through drill holes 38, 39. The front face 65 is an outer face of the stall structure 60 such that persons outside the stall structure can view the occupancy indicator 10. The indicator 10 extends past the edge 66 so that the slider block 14 is able to move substantially adjacent and parallel to the edge 66 and into a closed door space of the stall structure, i.e. the space occupied by the door when the door is in the closed position. In the depiction of FIG. 3, the door 62 is shown slightly ajar and the occupancy indicator 10 is in its default position with the slider block 14 extended to be adjacent the edge 66 of the pilaster and with the VACANT indicator 48 visible through the display window 27.

FIG. 4 shows the stall structure 10 once the door 62 has being closed to align with the pilaster 64. The action of closing the door causes the door to engage the front face 45 of the slider block 14 and push the slider block out of the door space. The door 62 pushes against the action of the springs 55 and urges the slider block 14 further into the slot 30 until the back surface 46 protrudes through an aperture 28 in the back wall 26 of the housing 12. The door continues its movement until the door abuts the mounting plate 16 or some other stop (not shown) of the stall structure 60. With the door fully closed, the slider block 14 has moved so that the VACANT indicator 48 is hidden by the side wall 23 of the housing 12 and the slider block 14 protrudes from the back end 26 of the housing 12 sufficient to display the OCCUPIED indicator 47.

Typically, the door 62 will be closed by an occupant within the stall. The occupant may latch the door using a suitable latch (not shown) or by pushing against the door to maintain the door closed. As long as the door is closed, the occupancy indicator will be in the position displaying the OCCUPIED indicator 47. When the occupant opens the door and leaves the stall, the springs 55 that were compressed when the door was closed return the slider block to the default position, thus hiding the OCCUPIED indicator 47 and displaying the VACANT indicator 48 once more.

It has been described that the slider block 14 is slideably positioned within the housing and selectively displays a "vacant" or "occupied" message depending on its position within the housing. Slider block 14 is moved from the "vacant" position to the "occupied" position by the action of the door and pilaster coming in parallel with each other as is the case when the door is latched. Springs 55 provide a biasing force so as to cause slider block 14 to be in the "vacant" position when the door is not latched. The biasing force also performs a secondary indication of vacancy by holding the door partially open.

Slider block 14 can be installed into the housing 12 in either of two directions, each 180 degrees from each other to accommodate either left hinged doors or right hinged doors. The device can accommodate both left hinged and right hinged doors by simply inserting the slider block into the housing such that the text of the indicators 47, 48 is in the appropriate orientation.

Indicator 10 mounts to the pilaster, or door frame, (in the case of doors that open "in") or to the door itself (in the case of doors that open "out"), with attachment devices, such as screws, rivets, adhesive, etc. When the indicator 10 is mounted to the door, the engagement surface of 45 of the slider block 14 will come into contact with the pilaster or door frame of the stall structure, rather than the door itself.

The occupancy indicator 10 is inexpensive to produce comprising of a small number of easily producible parts using common manufacturing processes. Indicator 10 may be made from injection molded plastic, composites (such as fiber glass), metal, wood, and many other materials.

The indicator 10 works regardless of type of latch (rotary, slide, hook & eye, etc.), regardless of whether the door is hinged on the right or left, and regardless of whether the door opens "in" or "out". The indicator requires no user input or intervention for operation.

First Alternative Embodiment

Figure 5:
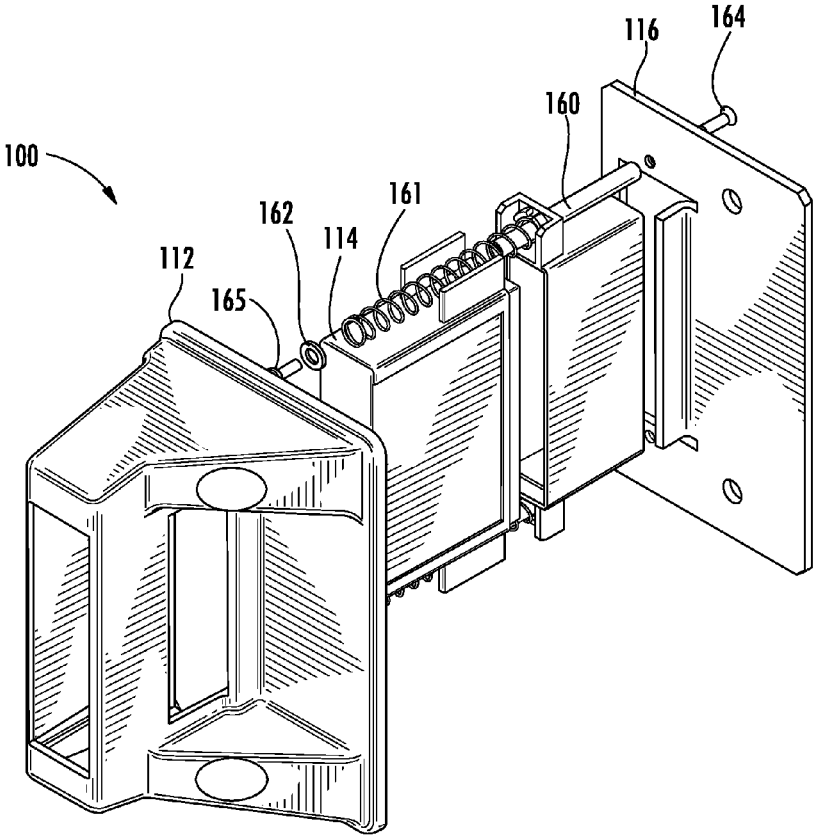
FIG. 5 is substantially an exploded view of an alternative indicator of the present invention.

An alternative embodiment 100 of the occupancy indicator is depicted in FIGS. 5-13. FIG. 5 depicts the assembly 100 in expanded view as including a housing 112, slider block assembly 114 and a mounting plate 116.

Figure 6:
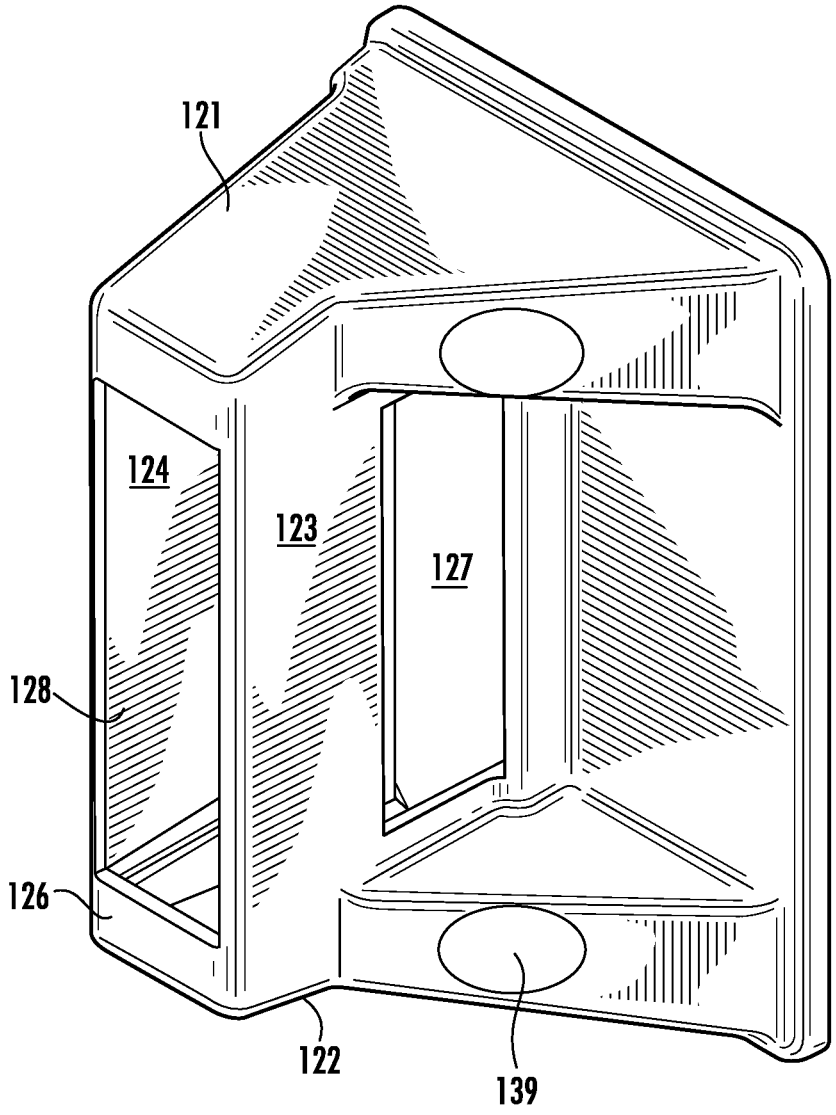
FIG. 6 substantially shows a housing.
Figure 7:
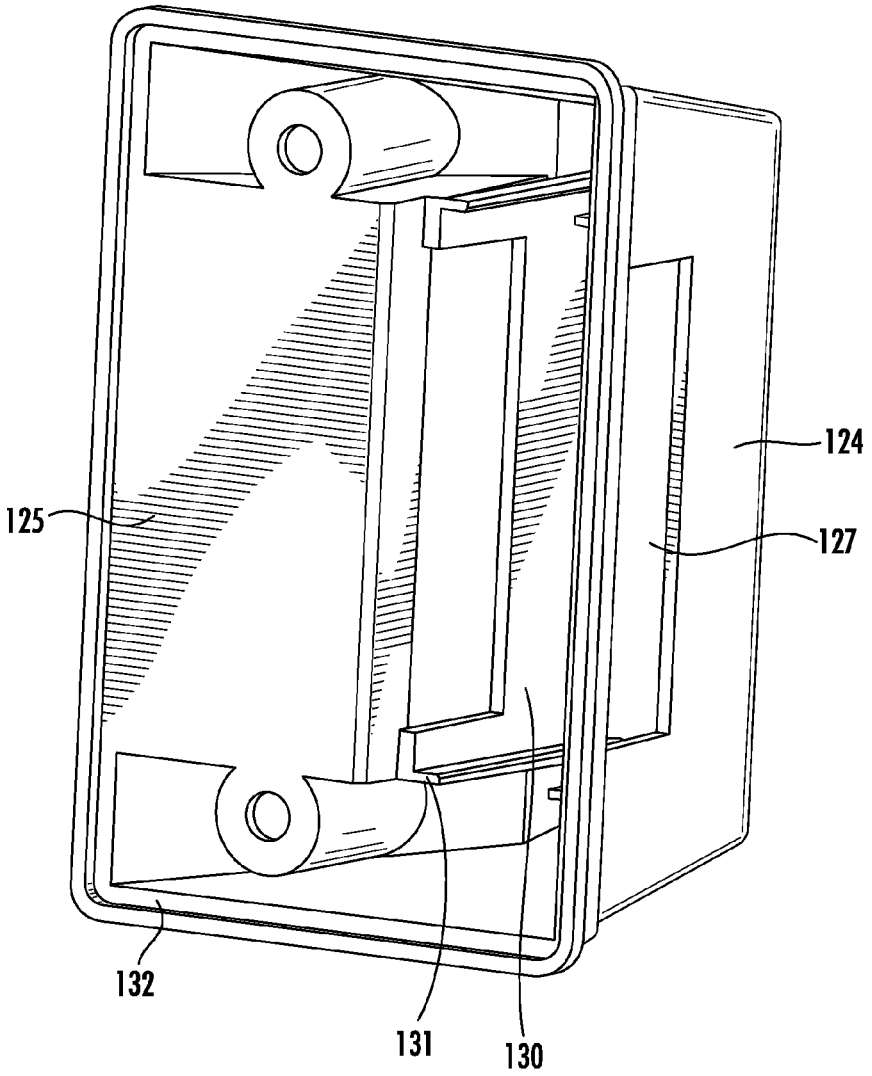
FIG. 7 substantially shows a reverse view of the housing.
Figure 8:
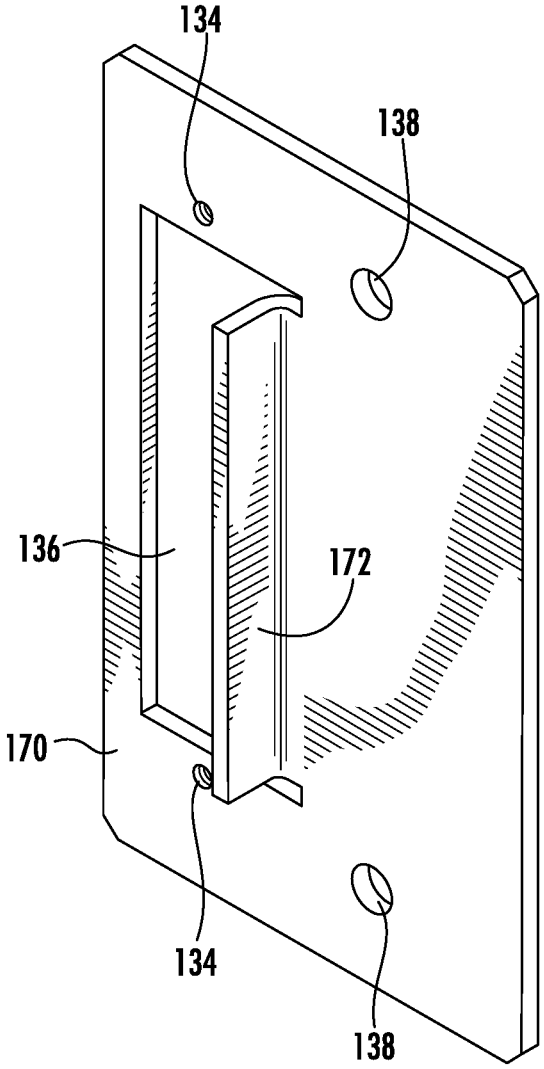
FIG. 8 substantially shows a mounting plate.
Figure 9:
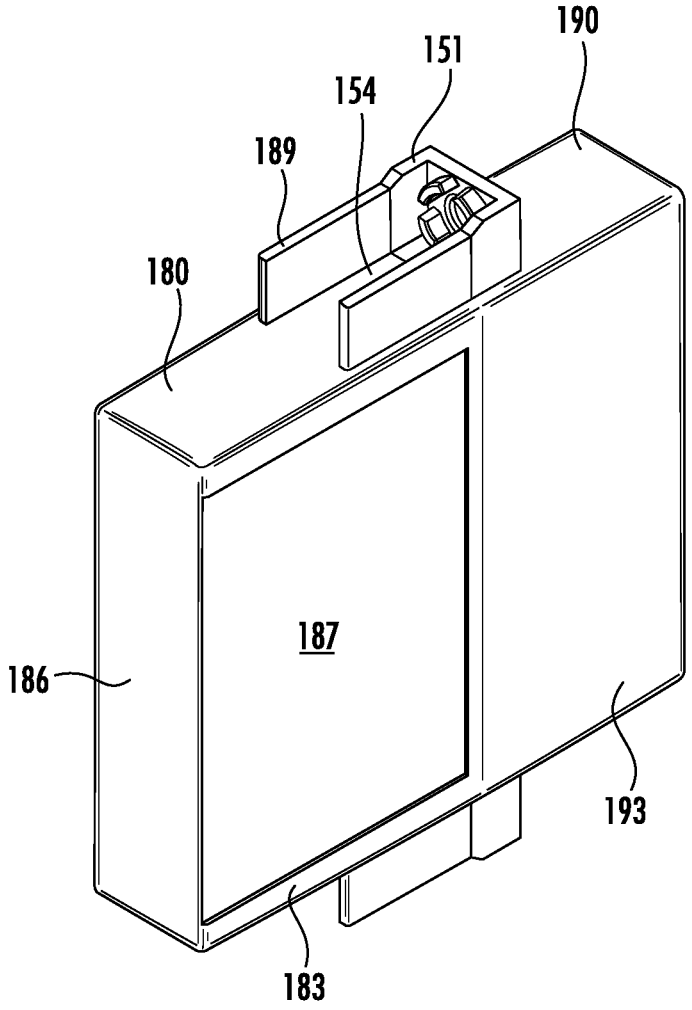
FIG. 9 substantially shows a slider block assembly.

The housing 112 is shown in more detail in FIGS. 6 and 7. The housing includes a top piece 121, bottom piece 122, opposing sides 123, 124, front 125 and back 126. The terms top, bottom, left, right, front, back and similar terms of orientation are used herein to aid in clarity of the description and are not intended to limit the orientation of the respective elements. The housing 112 may be manufactured from plastic using a suitable molding process.

The pieces of the housing 112 define an internal slot 130 which receives and retains the slider block 114 within the housing 112. The slot 130 extends from the front face 125 to the back face 126. An aperture 128 in the back face is provided that allows the slider block 114 to project from the back face 126 of the housing. Within the slot, formations 131 are used to retain the slider block assembly 114 within the housing 112.

The sides 123, 124, each include display apertures 127 that align with displays on the slider block for indicating status as will be described in more detail below.

The front 125 of the housing includes a recess 132 that receives the mounting plate 116. The mounting plate 116 is depicted in more detail in FIG. 8 with the rear surface 170 showing. The mounting plate is depicted as a rectangular piece sized to fit snugly within the recess 132. The mounting plate includes a slot 136 that aligns with the slot 130 of the housing and allows the slider block 114 to project from the front face 125 of the housing. An inward projection 172 aids to guide the slider block into the slot 136. Drill holes 138 are be provided in the housing and the mounting plate for securing the mounting plate 116 to the housing 12 and for securing the complete assembly to the stall structure.

The mounting plate also includes screw holes 174 for locating guide rods as will be described in more detail below.

Figure 10:
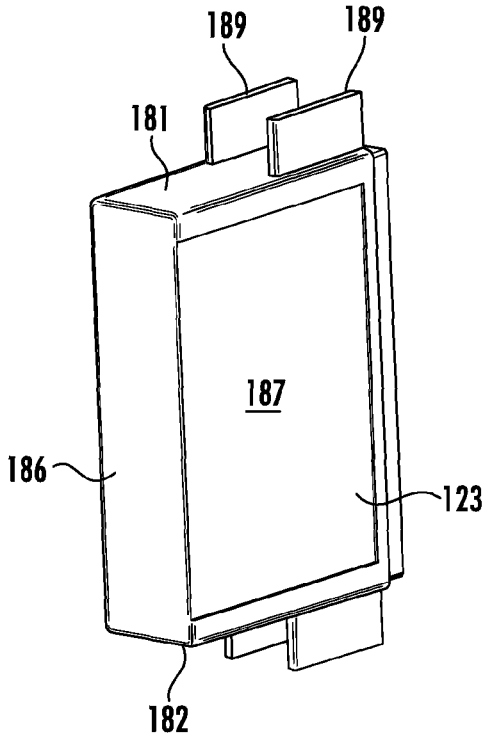
FIG. 10 substantially shows a display element.
Figure 11:
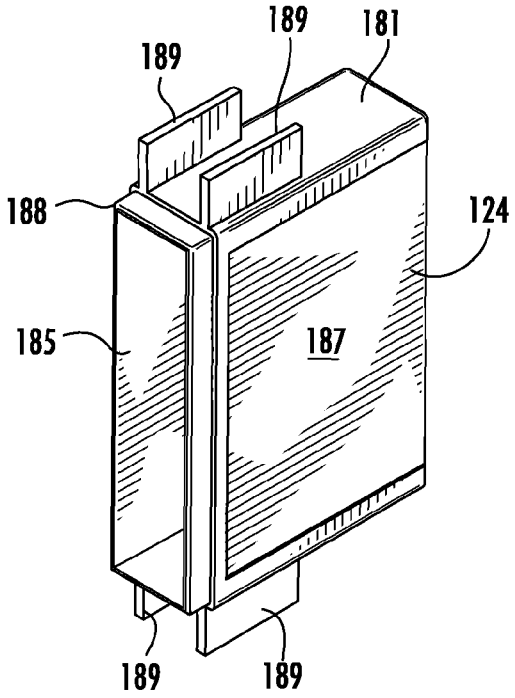
FIG. 11 substantially shows a reverse view of the display element

The slider block 114 is shown in more detail in FIGS. 9-13. The slider block 114 comprises a two piece structure having a display element 180 and an engagement element 190. The display element is shown in FIG. 10 and in reverse view in FIG. 11. The display element 180 has a generally rectangular shape and includes a top surface 181, bottom surface 182, sides 183, 184 and back surface 186. The front face 185 is open and includes a projection 188 around the inner periphery of the front face 185. Ribs 189 are formed on the upper and lower surfaces 181, 182.

Each of the sides 183, 184 includes a display area 187 that receives the OCCUPIED and VACANT indicators (not shown). As described previously, the indicators may be provided as adhesive labels, printing or embossing, and/or as color indicators. Other methods of providing the indicators will be apparent to the person skilled in the art.

Figure 12:
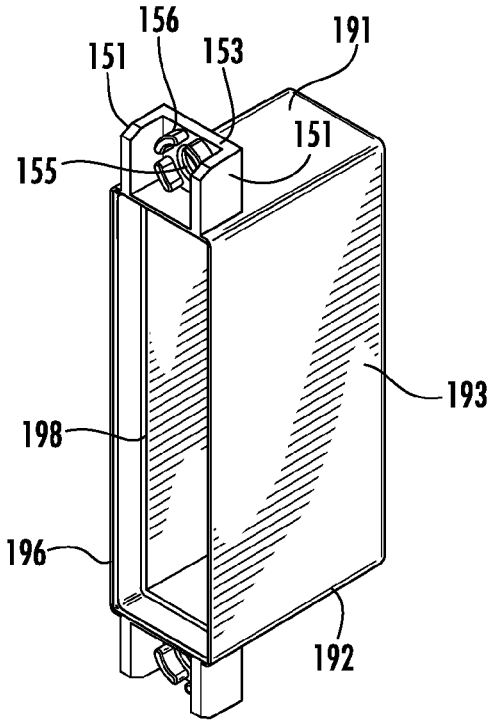
FIG. 12 substantially shows an engagement element.
Figure 13:
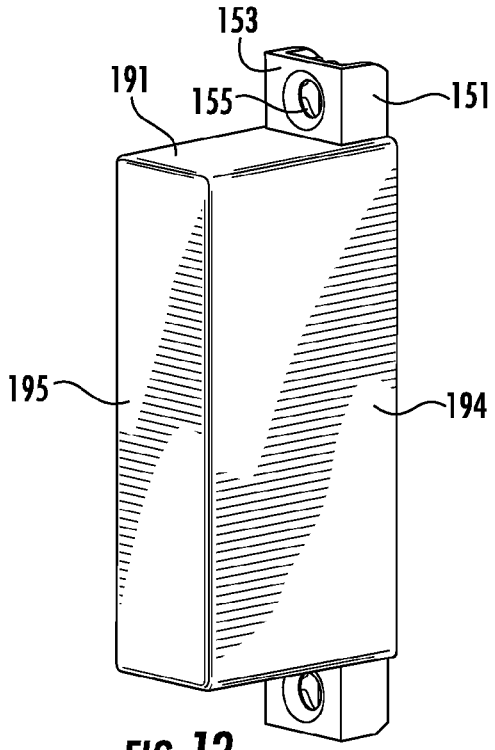
FIG. 13 substantially shows a reverse view of the engagement element.

The engagement element 190 is shown in FIG. 12 and in reverse view in FIG. 13. The engagement element has a generally rectangular shape and includes a top surface 191, bottom surface 192, sides 193, 194, front surface 195 and back 196. The back 196 is open and includes an inwardly projecting formation 198. The front surface 195 provides an engagement surface for engaging the stall structure when in use.

The top and bottom surfaces 191, 192 are each provided with a wall arrangement having opposing side walls 151 and an end wall 153. An aperture 155 is provided in the end wall 153. On an inner surface of the end wall 153, there are arranged a series of tabs 156 around the circumference of the screw hole 155.

When the display element 180 and engagement element 190 are assembled together (FIG. 9), the projection 188 of the display element is received within the open back face 195 of the engagement element 190 until the projection 188 abuts the formation 198, the front face 185 of the display element abuts the back face 195 of the engagement element 190 and the top, bottom and sides of the display element are flush with the respective top, bottom and sides of the engagement element 190. The ribs 189 align with the side walls 151 to from a channel 154.

FIG. 5 shows a biasing structure including an internally threaded guide rod 160, spring 161, washer 162 and end screws 164, 165. The guide rod 160 is secured to the mounting plate 116 through the screw holes 134 using end screw 164. The spring is provided over the guide rod 160 and retained in place by washer 162 and end screw 165.

The alternative indicator 100 may be assembled as follows. The guide rods 160 are secured to the mounting plate 116 using screws 164 or other suitable fasteners. The front face 195 of the engagement element 190 is inserted through the slot 136 of the mounting plate 116 with the guide rods 160 passing through the apertures 155 in the end walls 153. The springs are then located over the guide rods and secured by the washer 162 and end screw 165. The springs are received within the tabs 156 are thus constrained between the end wall 153 and the washer 162, thereby biasing the engagement element 190 to protrude through the slot 136 in the mounting plate 116.

The assembly to this point may be performed with only the engagement element 190 or with the complete slider assembly 114 including the engagement element 190 and display element 180. If not previously assembled, the display element 180 is connected to the engagement element 190 and the housing is provided over the slider assembly with the slider assembly being received within the slot 130 of the housing.

The indicator 100 may then be secured together and to the stall structure by providing screws or similar fasteners through the drill holes 139 of the housing and mounting plate 138. The alternative indicator 100 is secured in a similar manner to the indicator 10 shown in FIGS. 2-4.

The operation of the alternative indicator 100 is similar to that described previously. In a default position, the engagement surface 195 projects from the slot 136 of the mounting plate and the display element is disposed so that a VACANT indicator aligns with the display aperture 127. When the door of the stall is closed, the engagement surface 195 engages the stall structure, i.e. either the door (for inward opening doors) or the frame (for outward opening doors), causing the slider assembly to be pushed within the housing so that the display element 180 protrudes from the aperture 128 in the back surface 126 of the housing 112, thereby displaying the OCCUPIED indicator and hiding the VACANT indicator.

The action of closing the door and moving the slider assembly 114 compresses the springs 161. When the door is opened, the springs rebound, thereby returning the slider assembly to the default position with the VACANT indicator displayed.

Second Alternative Embodiment

An alternative embodiment of the occupancy indicator is depicted in FIGS. 14-26. In this embodiment, the linearly moving display element of earlier embodiments is replaced with a rotating display element 280. The rotating element 280 is located within a housing 212 and is viewable through an aperture 228 in the housing 212. The rotating display element 280 may take various forms. In FIG. 15, the rotating display element 280 is cylindrical having a longitudinal axis 281, a circumferential surface 282 and circular ends 283, 284. The circumferential surface provides a display surface. On a first portion of the display surface there is provided a VACANT indicator (shown) and on a second portion of the display surface there is provided a OCCUPIED indicator (not shown). Each indicator may cover approximately 50% of the display surface. Alternatively, each indicator may cover a smaller portion of the display surface corresponding to the amount of the display surface that is visible when the rotating display element is located within the housing. For example, if 60 degrees of the circumferential surface is displayed at any one time, then the indicator need only cover 60 degrees of the circumferential surface.

In an alternative embodiment, the rotating element may be a rectangular element 380 (FIG. 16) having a longitudinal axis 381 and indicator faces 382, 383. In a further alternative embodiment, the rotating element may be a triangular element 480 (FIG. 17) having a longitudinal axis 481 and indicator faces 482, 483, 484, of which only two may be used to display the OCCUPIED and VACANT indicators.

Figure 14:
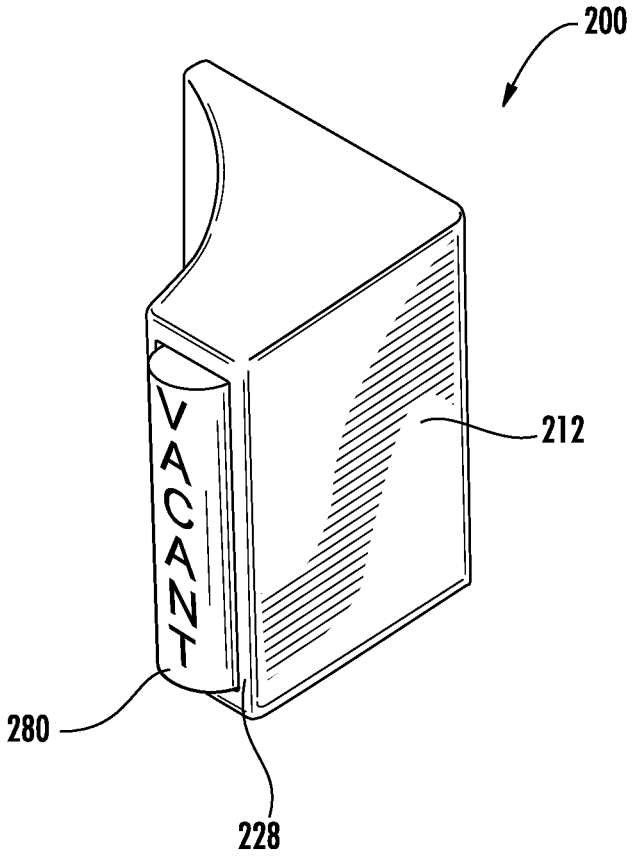
FIG. 14 substantially shows an embodiment of the occupancy indicator having a rotating display.
Figure 15:
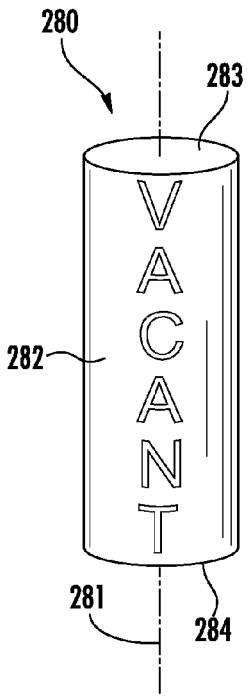
FIG. 15 substantially shows a cylindrical display.
Figure 16:
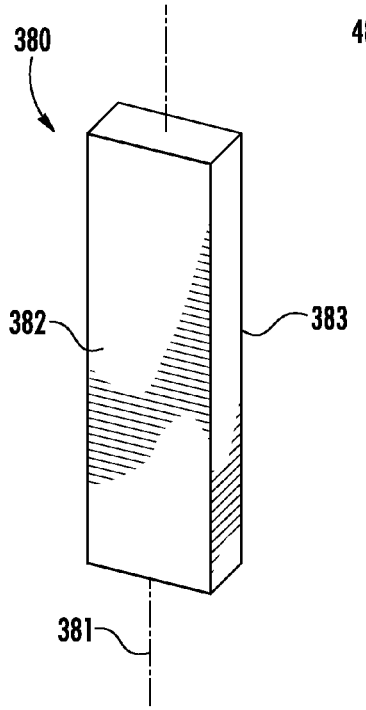
FIG. 16 substantially shows a rectangular display.
Figure 17:
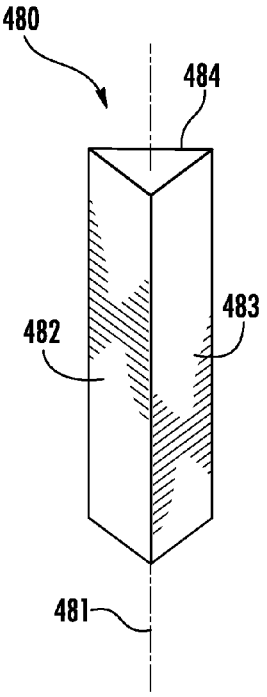
FIG. 17 substantially shows a triangular display.

As shown in FIG. 14, the rotating display element 280 is mounted within the housing 212 so that the longitudinal axis 281 is vertical and so that the display element either projects at least partially from the aperture 228 in the rear face 226 of the housing or can at least be viewed through the aperture 228. The display element is mounted for rotation about the longitudinal axis. While the display element is shown with the longitudinal axis vertical, the display element may also be mounted horizontally. An at least partially clear protective cover may optionally be provided over display element 280. When mounted, only a portion of the display element is viewable so that in one position, the VACANT indicator will be viewable while in another position, the OCCUPIED indicator will be viewable.

Within the occupancy indicator 200 is an engagement element 290 that engages the stall structure through the action of closing the door of the stall structure. The engagement element is operatively connected to the display element 280 so that during the action of closing the door of the stall structure, the engagement element causes the display element to rotate from a VACANT indicating position to an OCCUPIED indicating position. The engagement element may be similar in structure to the engagement element described in previous embodiments, including an engagement surface that engages the stall structure during the action of closing the door of the stall structure. The engagement element may be operatively connected to the display element in a variety of means.

Figure 18:
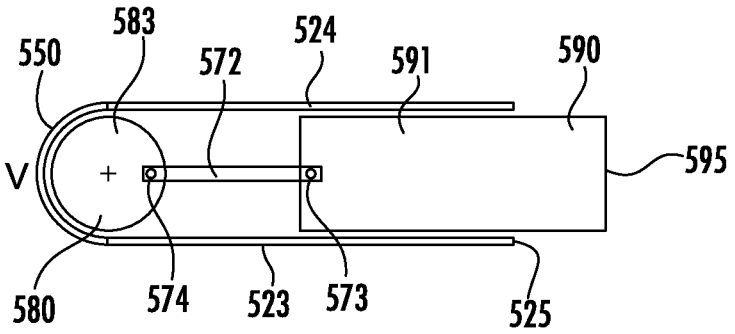
FIG. 18 substantially shows a mechanical connector arrangement in a vacant indicating position.
Figure 19:
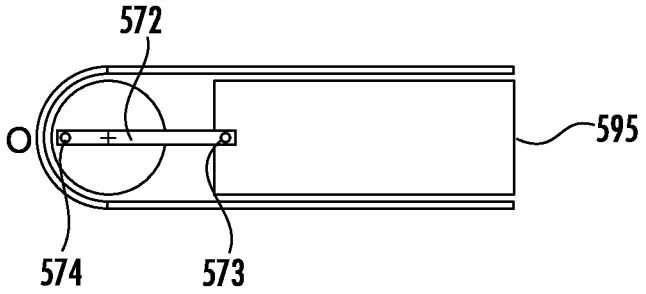
FIG. 19 substantially shows the mechanical connector arrangement in an occupied indicating position.

In one embodiment, the connection between the engagement element and the display element is a mechanical connection. FIG. 18 is a top view that schematically depicts one form of mechanical connection. FIG. 18 shows the housing sides 523, 524, rotating display element 580, engagement element 590 and mechanical connector 572. Also shown is an at least partially clear protective cover over 550 over that encases the display element. The engagement element has an engagement surface that in the default position (FIG. 18) extends from the housing through the front face 525. In this position, the VACANT indicator is viewable on the display element 580 through the cover 550 as denoted by the "V" symbol in FIG. 18. The mechanical connector includes a connector rod 572 that is pivotally mounted at one end 573 to the top surface 591 of the engagement element 590 and at the other end 574 to a top end face 583 of the display element 580. Alternatively or in addition, the connector rod may be mounted to the bottom surfaces of the engagement element and the display element. The pivot connections 573, 574 allow the rod 572 to pivot relative to the respective mountings, while maintain a fixed distance between the pivot connections 573, 574. Thus, when the stall structure contacts the engagement surface 595 and the engagement element is pushed inward of the housing, the connector rod 572 rotates the display element to the position shown in FIG. 19, in which the OCCUPIED indicator is now viewable, as denoted by the "0" symbol in FIG. 19.

The assembly may be biased to the position shown in FIG. 18 by any suitable biasing means. For example, the engagement element may compress one or more coil springs as it moves inward of the housing so that when pressure is released from the engagement surface, the engagement element is pushed outwards by the return of the springs. Alternatively or in addition, the display element may be mounted on a winding spring so that as the display element rotates, the spring is wound and will naturally unwind when the pressure is released.

Figure 20:
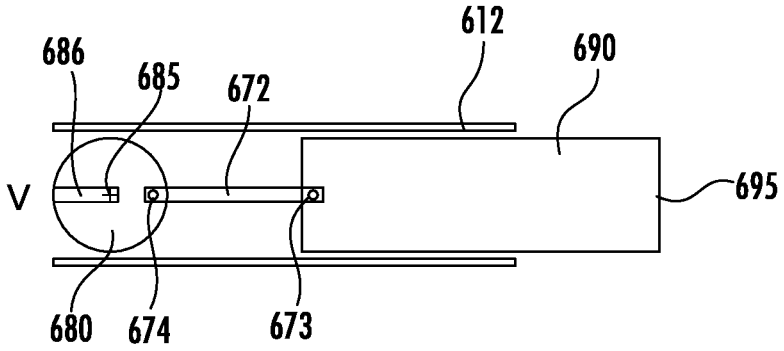
FIG. 20 substantially shows an alternative mechanical connector arrangement in a vacant indicating position.
Figure 21:
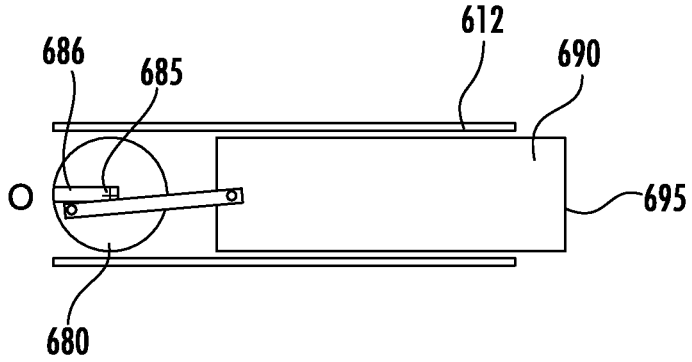
FIG. 21 substantially shows the alternative mechanical connector arrangement in an intermediate position.
Figure 22:
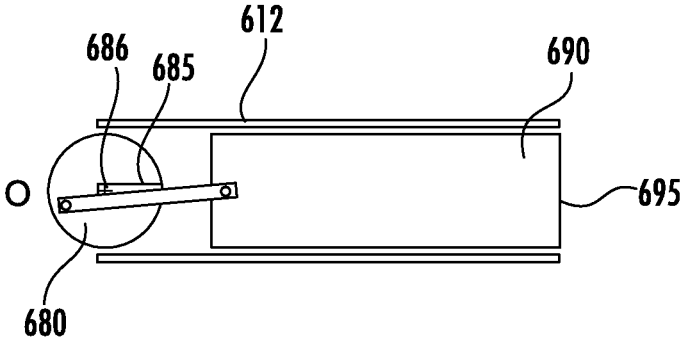
FIG. 22 substantially shows the alternative mechanical connector arrangement in an occupied indicating position.

In one embodiment, the display element may be mounted to both rotate and move linearly. As shown in FIGS. 20-22, the display element 680 may be mounted on its longitudinal axis by a rotating pin 685. The pin itself may be located in a groove 686 of the housing that allows the longitudinal axis to travel back and forth within the groove. The engagement element 690 may project sufficiently from the housing 612 so that the amount of travel of the engagement element due to the action of the closing of the door of the stall structure both rotates and translates the display element. For example, in a default VACANT position of FIG. 20, the engagement element 609 projects from the housing 612. As the door closes and contacts the engagement surface 695, the engagement element 690 is pushed through a range of travel. In an intermediate position (FIG. 21), the engagement element 690 has rotated the display element 680 from the VACANT indicating position to the OCCUPIED indicating position. As the engagement element continues its motion, the connector rod 672 is unable to rotate the display element any further and therefore the rod 672 pushes the display element 680 away causing the mounting pin 685 to slide within the groove 686 until the display element protrudes partially from the housing (FIG. 22). In this embodiment, the cover is removed to allow the display element 680 to project from the housing 612. Alternatively, the cover may be provided in a position that accommodates the projecting display element. This embodiment has the advantage of making it more apparent that the stall is occupied, by virtue of the projecting display element.

Figure 23:
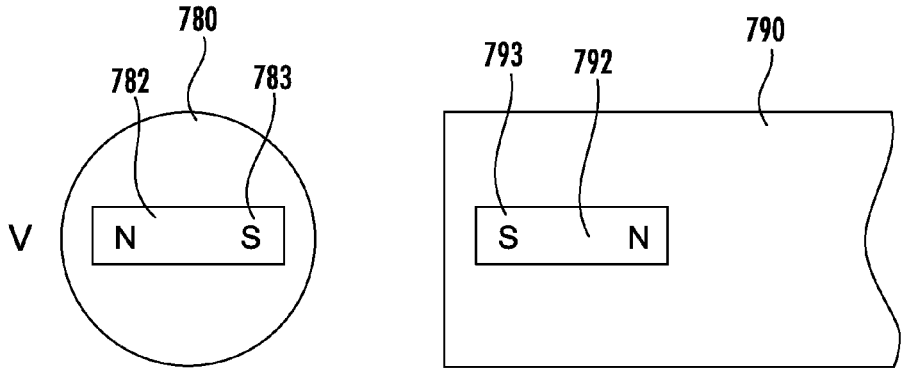
FIG. 23 substantially shows a magnetic connector arrangement in a vacant indicating position.
Figure 24:
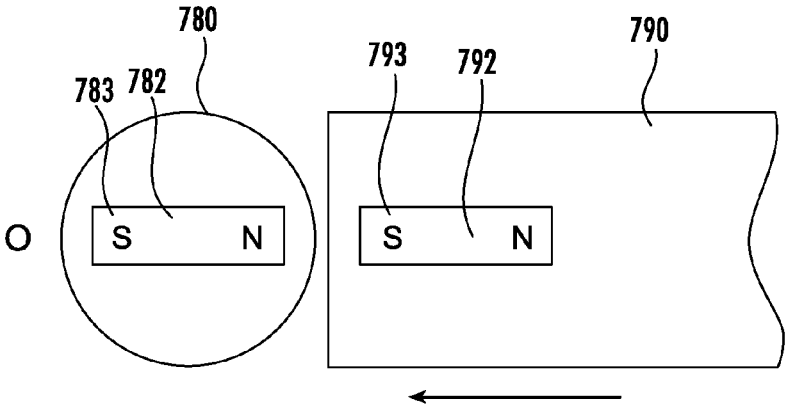
FIG. 24 substantially shows the magnetic connector arrangement in an occupied indicating position.

In a further embodiment, the connector may be a magnetic connector. FIG. 23 shows an embodiment in which the operative connection between the display element 780 and the engagement element 790 is a magnetic connection. In FIG. 23, the details of the housing have been omitted for clarity. In the default position of FIG. 23, the engagement element 790 is away from the display element 780 and the display element is biased by some biasing means such as the means described previously to the VACANT indicating position as denoted by the symbol "V". The display element 780 and engagement element 790 each have a magnet 782, 792 respectively aligned with the north and sole poles as depicted, though the person skilled in the art will readily understand that the poles could also be reversed. That is, like poles 783, 793 of the display element 780 and the engagement element 790 face each other in the default position. Due to the separation of the display element 780 and the engagement element 790, the biasing force on the display element overcomes the magnetic repulsion and the display element remains in the VACANT indicating position. However, when the engagement element 790 is moved closer to the display element 780 by the action of closing the door of the stall structure (FIG. 24), the magnetic repulsion of the like poles 783, 793 overcomes the biasing force, causing the display element to rotate to the OCCUPIED indicating position.

Figure 25:
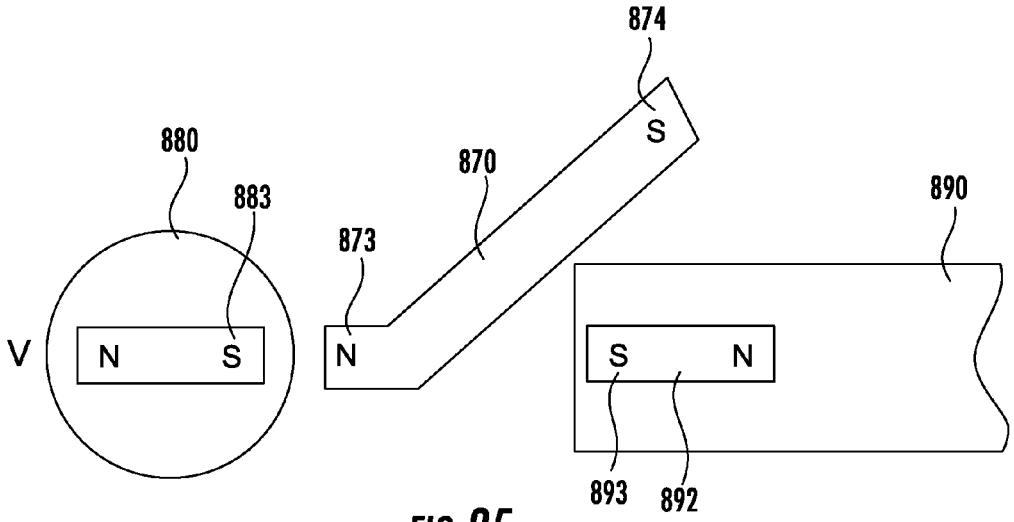
FIG. 25 substantially shows a magnetic connector arrangement with a magnetic biasing arm in a vacant indicating position.
Figure 26:
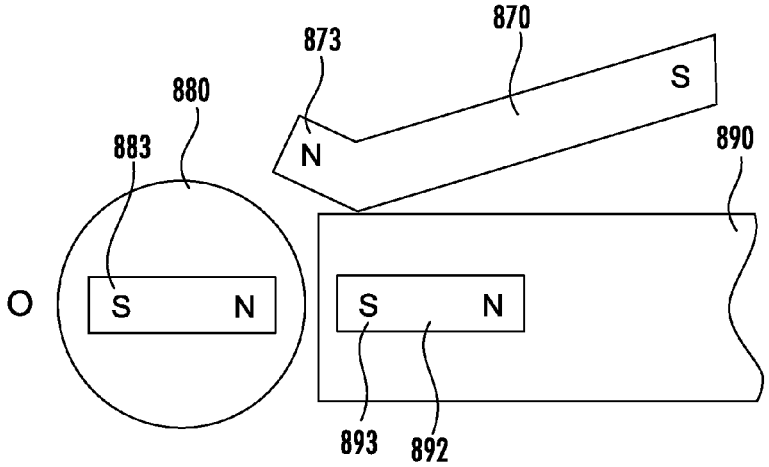
FIG. 26 substantially shows the magnetic connector arrangement with a magnetic biasing arm in an occupied indicating position.

In one embodiment, the biasing means may itself be magnetic. In FIG. 25, there is shown a magnetic connector similar to the connector of FIGS. 23-24. In addition to the magnet 892 of the engagement element, there may also be provided a biasing arm 870 having a magnetic end 873. The biasing arm 870 may be pivotally connected to the housing at a fixed end 874. The free end 873 may be biased by a spring, gravity or other biasing means to the position shown in FIG. 25 in which the free end aligns with the magnet of the display element. The polarity of the end 873 is opposite to polarity to the magnet end 883 of the OCCUPIED face of the display element 880. That is, in the default position of FIG. 25 in which the engagement element 890 is away from the display element 880, the end 873 of the biasing arm 870 is adjacent the display element 880 and thus attracts the OCCUPIED face, causing the VACANT face of the display element to be outwardly displayed (FIG. 26).

When the engagement element 890 is moved by the action of closing the door of the stall structure, the engagement element 890 pushes the biasing arm 870 away from the display element 880 and brings the pole 893 of the magnet 892 of the engagement element into close proximity with the display element. The magnetic repulsion between the display element 880 and the engagement element 890 thus causes the display element to rotate to the VACANT indicating position. The initial movement of the biasing arm 870 will cause an initial rotation of the display element 880 in the same direction as the movement of the biasing arm and will thus cause the display element to rotate in the same direction each time. This can be advantageous, for example if less than 180 degree rotation is required for changing the display of the indicator.

While the embodiments described above typically show the display element as being mounted vertically, other orientations such as horizontal or angled are also considered to be within the scope of the invention.

An advantage of the present mechanism over other indicators that are incorporated into the latch include that the present mechanism can be provided at an appropriate viewing height while latch mechanisms must be disposed at a lower height for easy reach and use by the occupant, in particular children.

The present description makes specific reference to the terms OCCUPIED and VACANT as indicating respective occupied and vacant status of the stall. However, these terms are considered as examples only and many forms of text, colors, symbols or the like may be used to indicate occupied and vacant states or other states that may be indicated by the indicator. For example, the color red may be used to indicate an occupied state while the color green may indicate a vacant state, without or without any additional text or symbols.

Although the description above contains many specifications, these should not be construed as limiting the scope of the invention but as merely providing illustrations of some of the embodiments of this invention. Thus, the scope of the invention should be determined by the appended claims and their legal equivalents rather than by the examples given.

What is claimed is:

1. An occupancy indicator for use in a stall structure comprising a door, the occupancy indicator comprising:

(A) a housing;

(B) a mounting arrangement for mounting the housing to the stall structure;

(C) a display element retained in the housing, the display element moveable between at least two distinct positions, the at least two distinct positions comprising a vacant indicating position and an occupied indicating position; and (D) at least one engagement surface operatively connected to the display element so that movement of the engagement surface causes movement of the display element between the vacant indicating position and the occupied indicating position;

(E) wherein, in use, the mounting arrangement is mounted to the stall structure such that the action of closing the door of the stall structure causes the at least one engagement surface to engage the stall structure and to be moved by the stall structure, wherein the movement of the engagement surface by the action of closing the door of the stall structure causes the display element to move from the vacant indicating position to the occupied indicating position;

(F) wherein the housing comprises a first aperture for viewing the display element in the vacant indicating position and a second aperture for viewing the display element in the occupied indicating position.

2. The occupancy indicator of claim 1 wherein the display element projects from the housing in the occupied indicating position.

3. The occupancy indicator of claim 1 comprising a slider block, the slider block comprising the display element and the engagement surface, wherein the housing comprises a first slot within the housing, wherein the slider block slides within the first slot between the vacant indicating position and the occupied indicating position.

4. The occupancy indicator of claim 3 wherein the mounting arrangement comprises a second slot aligned with the first slot, wherein the engagement surface comprises an end surface of the slider block, and wherein the slider block including the engagement surface projects from the housing in the vacant indicating position.

5. The occupancy indicator of claim 3 wherein the slider block comprises a side surface, the side surface comprising a vacant indicator and an occupied indicator adjacent the vacant indicator, wherein when the slider block is in the vacant indicating position, the vacant indicator is viewable through the first aperture and wherein the occupied indicator is hidden within the housing.

6. The occupancy indicator of claim 5 wherein when the slider block moves from the vacant indicating position to the occupied indicating position, the slider block including the occupied indicator projects from the housing through the second aperture and the vacant indicator is hidden within the housing.

7. The occupancy indicator of claim 1 comprising at least one biasing element that biases the display element to the vacant indicating position.

8. The occupancy indicator of claim 1 wherein the display element comprises a rotating element comprising at least one vacant indicator and at least one occupied indicator, wherein the display element is operatively connected to the engagement surface such that the movement of the engagement surface by the action of closing the door of the stall structure causes the display element to rotate from the vacant indicating position to the occupied indicating position.

9. The occupancy indicator of claim 8 wherein the display element is operatively connected to the engagement surface by a mechanical connector.

10. The occupancy indicator of claim 8 wherein the display element is operatively connected to the engagement surface by a magnetic connector.

11. The occupancy indicator of claim 10 comprising a biasing element that biases the display element to the vacant indicating position.

12. The occupancy indicator of claim 11 wherein the biasing element comprises at least one magnetic element.

13. The occupancy indicator of claim 1 wherein the orientation of the display element within the housing can be changed to allow the occupancy indicator to be mounted on a left hinged door and a right hinged door by changing the orientation of the display element within the housing.

14. The occupancy indicator of claim 1 wherein the occupancy indicator is configured to be mounted on a door of the stall structure such that the engagement surface engages a pilaster of the door structure during the action of closing the door.

15. The occupancy indicator of claim 1 wherein the occupancy indicator is configured to be mounted on a pilaster of the stall structure such that the engagement surface engages the door structure during the action of closing the door.

16. A stall structure comprising:

(A) a first pilaster;

(B) a second pilaster;

(C) a closed door space between the first pilaster and the second pilaster;

(D) a door hingedly connected to the first pilaster; and (E) an occupancy indicator comprising:

(a) a housing comprising a first slot within the housing;

(b) a mounting arrangement for mounting the housing to the stall structure;

(c) a slider block that slides within the first slot between a vacant indicating position and an occupied indicating position, the slider block comprising an engagement surface such that movement of the engagement surface causes movement of the slider block between the vacant indicating position and the occupied indicating position;

(d) wherein, in use, the mounting arrangement is mounted to the stall structure such that the action of closing the door of the stall structure causes the engagement surface to engage the stall structure and to be moved by the stall structure, wherein the movement of the engagement surface by the action of closing the door of the stall structure causes the slider block to move between the vacant indicating position and the occupied indicating position;

(e) wherein the engagement surface extends from the housing when the door is in the open position.

17. The stall structure of claim 16 wherein the occupancy indicator is mounted to the second pilaster and the engagement surface engages the door during the action of moving the door into the closed door space.

18. The stall structure of claim 17 wherein the engagement surface extends into the door space when the door is in an open position.

19. The stall structure of claim 16 wherein the occupancy indicator is mounted to the door and wherein the engagement surface engages the second pilaster during the action of moving the door into the closed door space.

20. The stall structure of claim 16 comprising a display element that is rotatably mounted within the housing and wherein the slider block is operatively connected to the display element such that sliding movement of the slider block causes the display element to rotate.

21. An occupancy indicator for use in a stall structure comprising a door, the occupancy indicator comprising:

(A) a housing comprising a first slot within the housing;

(B) a mounting arrangement for mounting the housing to the stall structure;

(C) a slider block that slides within the first slot between a vacant indicating position and an occupied indicating position, the slider block comprising a display element and an engagement surface such that movement of the engagement surface causes movement of the slider block between the vacant indicating position and the occupied indicating position; and (D) wherein, in use, the mounting arrangement is mounted to the stall structure such that the action of closing the door of the stall structure causes the engagement surface to engage the stall structure and to be moved by the stall structure, wherein the movement of the engagement surface by the action of closing the door of the stall structure causes the slider block to move between the vacant indicating position and the occupied indicating position.

22. The occupancy indicator of claim 21 wherein the mounting arrangement comprises a second slot aligned with the first slot, wherein the engagement surface comprises an end surface of the slider block, and wherein the slider block including the engagement surface projects from the housing in the vacant indicating position.

23. The occupancy indicator of claim 21 wherein the slider block comprises a side surface, the side surface comprising a vacant indicator and an occupied indicator adjacent the vacant indicator, the housing comprising at least one first aperture in at least one side wall of the housing, wherein when the slider block is in the vacant indicating position, the vacant indicator is viewable through the at least one first aperture and wherein the occupied indicator is hidden within the housing.

24. The occupancy indicator of claim 23 wherein the housing comprises at least one second aperture in an end wall of the housing, wherein when the slider block moves from the vacant indicating position to the occupied indicating position, the slider block including the occupied indicator projects from the housing through the at least one second aperture and the vacant indicator is hidden within the housing.

* * * * *